US005458064A

United States Patent [19]

Kearns

[11] Patent Number: 5,458,064

[45] Date of Patent: Oct. 17, 1995

[54] FIREARM PROJECTILE

[76] Inventor: Robert M. Kearns, 5435 N. Hertford Way, Boise, Id. 83703

[21] Appl. No.: 235,357

[22] Filed: Apr. 29, 1994

[51] Int. Cl.[6] ..... F42B 14/06

[52] U.S. Cl. ..... 102/520; 102/532

[58] Field of Search ..... 102/520–527, 102/532; 42/90

[56] References Cited

U.S. PATENT DOCUMENTS

| | | | |
|---|---|---|---|
| 34,950 | 4/1862 | James | 102/520 |
| 35,273 | 5/1862 | Williams | 102/532 |
| 36,879 | 11/1862 | Bird | 102/532 |
| 43,017 | 6/1864 | Ganster | 102/520 |
| 384,574 | 6/1888 | Hawley | 102/520 |
| 405,690 | 6/1889 | Ball | 102/522 |
| 1,327,655 | 1/1920 | Dougan | 102/522 |
| 2,389,846 | 11/1944 | Ericson | 102/523 |
| 2,911,911 | 11/1959 | White | 102/532 |
| 3,744,426 | 7/1973 | Butler | 102/527 |
| 4,175,493 | 11/1979 | Dailey | 102/532 |
| 4,549,488 | 10/1985 | Hoffmann et al. | 102/522 |
| 4,587,905 | 5/1986 | Maki | 102/532 |
| 5,150,909 | 9/1992 | Fitzwater | 102/522 |

FOREIGN PATENT DOCUMENTS

| | | | |
|---|---|---|---|
| 23676 | 12/1921 | France | 102/522 |
| 2606135 | 8/1977 | Germany | 102/520 |
| 305202 | 12/1936 | Italy | 102/522 |
| 1667 | of 1868 | United Kingdom | 102/525 |

*Primary Examiner*—Harold J. Tudor

*Attorney, Agent, or Firm*—Ken J. Pedersen; Barbara S. Pedersen

[57] ABSTRACT

A projectile for firearms and for muzzle loading firearms, in particular, said projectile including a bullet; a gas check member; and a pin or cavity affixed to the bullet and a mating member affixed to the gas check member for frictional attachment of bullet to gas check member. The bullet has a diameter less than the bore of the firearm to minimize scoring or deformation of the bullet during the loading procedure; to facilitate loading; and to improve the ballistics of the bullet; and the gas check member being constructed of resilient plastic material and having a diameter exceeding the diameter of the bore for holding the bullet in place within the bore over the charge. The gas check member attaches by the mating attachment members to the bullet rearward of the maximum diameter of the bullet to prevent any interference between bullet and bore as the bullet obturates during firing. The gas check member frictionally and resiliently engages the bullet for convenience in manual attachment of the gas check member to the bullet prior to loading as well as for ready detachment immediately after firing to prevent bullet drag and to enhance ballistic integrity.

2 Claims, 1 Drawing Sheet

FIG.1
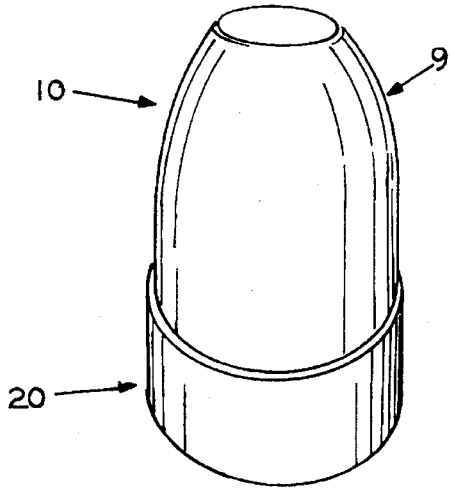
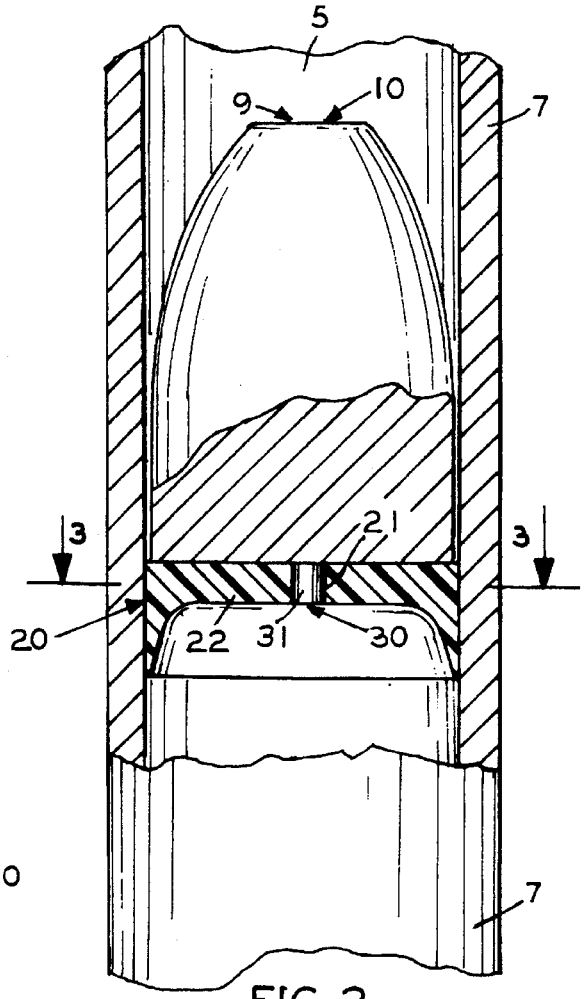
FIG.2
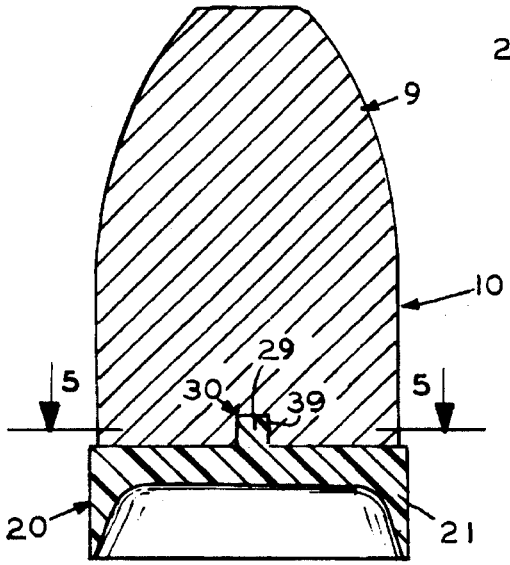
FIG.4
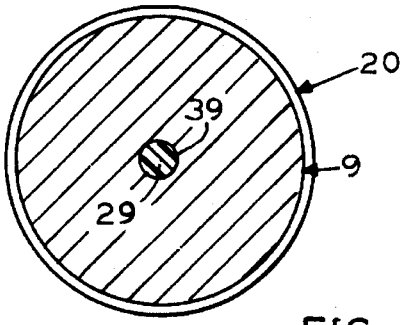
FIG.5
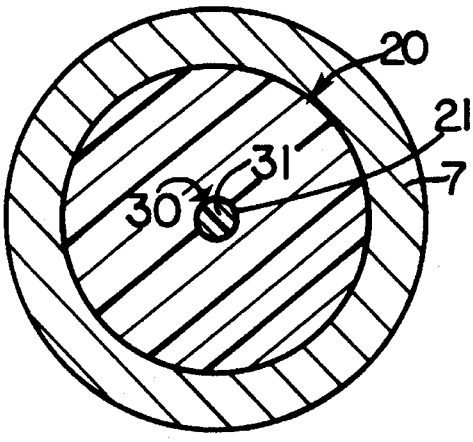
FIG. 3

FIREARM PROJECTILE

BACKGROUND OF THE INVENTION

1. Field of the Invention

This invention relates, in general, to projectiles for firearms, and, more particularly, to projectiles for muzzle loading firearms.

2. Description of the Prior Art

To function most efficiently, muzzle loading firearms preferably have a projectile and a wad or gas check member between the projectile and the powder charge. In the early years of muzzle loaders, a lead projectile was ram-rodded down the bore of the firearm for placement over the powder charge. The diameter of the projectile, of necessity, exceeded the diameter of the bore for holding the projectile in place within the bore.

Later in the history of muzzle loaders came ordnance in which the wad was directly attached to the ball or bullet as typified by U.S. Pat. Nos. 35,273, issued to D. D. Williams and 43,017 issued to G. P. Ganster.

Since the early inventions, it has become common to use sabots or wrappers, surrounding the bullet, to engage the bore of the firearm to hold the projectile in place and to, where the bore is rifled, impart spin to the bullet. Such wrappers are conventionally made of expansive packing such as molding paper, leather or the like, as typified by U.S. Pat. No. 34,950, issued to C. T. James and U.S. Pat. No. 405,690, issued to A. Ball.

Primary disadvantages of known projectiles for muzzle loaders relate to dimensions of the bullet and placement of the gas check member.

Where the bullet's maximum diameter exceeds that of the bore of the firearm, scoring of the bullet from its contact with the rifling as well as deformation of the bullet from the rod-ramming process results, causing degeneration of the ballistic qualities of the bullet. Additionally, because of the contact between bore and bullet, the firearm is more difficult to load; the loading process being impeded when a follow-up shot may be needed in a hurry.

Where wrappers or sabots are used to surround the bullet, such wrapper itself engages both bullet and bore and such structure is indeed required where rifling of the bore is intended to impart spin to the wrapper and hence the bullet. Such wrapping, in surrounding the bullet and hence being located between bullet and bore, results in interference between the bullet and the bore—possibly effecting the ballistic qualities of the bullet exiting the bore. Where the gas check member does not detach from the bullet upon firing, velocity may be impeded.

SUMMARY OF THE INVENTION

The present invention provides a projectile having a bullet, constructed of any suitable obturating material such as lead, which has a maximum diameter which is less than the diameter of the bore and which includes a gas check member which is located rearwardly of the bullet and which does not surround the bullet; and the projectile further having a gas check member having a diameter exceeding that of the bore.

It is therefore a primary object of the present invention to provide a projectile having in combination a bullet having a diameter less than the bore of the firearm into which it is inserted and to have a gas check member attachable to the bullet rearwardly of the maximum diameter of the bullet to prevent interference between the bullet and the bore and for holding the projectile in place within the bore in addition to its gas check function.

It is also an object of the present invention to provide a projectile for muzzle loading firearms which has a bullet having a maximum diameter which is less than that of the bore of the firearm so as to prevent scoring and deformation of the bullet during placement of the projectile into the bore.

Another object of the present invention is to provide a projectile for muzzle loading firearms which is easier, faster, and more convenient to load.

Still another object of the present invention is to provide a projectile for muzzle loading firearms which has a gas check member located rearwardly of the bullet; which is of greater diameter than the bullet; and which is readily detachable from the bullet upon firing of the firearm.

Additional objects and advantages will become apparent and a more thorough and comprehensive understanding may be had from the following description taken in conjunction with the accompanying drawings forming a part of this specification.

BRIEF DESCRIPTION OF THE DRAWINGS

FIG. 1 is a perspective view of a projectile made according to the present invention.

FIG. 2 is a side sectional view of a projectile made according to the present invention, shown placed within the bore of a firearm.

FIG. 3 is a sectional view taken along lines 3—3 of FIG. 2.

FIG. 4 is a side sectional view of a second embodiment of the projectile of the present invention.

FIG. 5 is a sectional view taken along lines 5—5 of FIG. 4.

DETAILED DESCRIPTION OF THE INVENTION

Referring now to the drawings, two embodiments of a projectile 10 made according to the present invention are disclosed. Projectile 10 includes a bullet 9; a gas check member 20 and means for attachment of the gas check member to the bullet, designated, generally, by the numeral 30. The difference in one embodiment, shown in FIGS. 2 and 3 and a second embodiment, shown in FIGS. 4 and 5, are in attachment means 30, as will hereinafter be explained. External appearance of the two embodiments shown is the same, as seen in FIG. 1.

Bullet 9 is constructed of any suitable obturating material, lead being preferred. The bullet is circular in cross-section, as is conventional, but unconventionally, has a maximum diameter, which is critical to the present invention, less than the bore 5 of the firearm barrel into which it is inserted. The diameter of the "bore", as the term is used herein and in the appended claims, refers to the distance between opposing land surfaces where the bore is rifled and the distance between opposing surfaces where the bore is smooth; the land being the raised portion of a grooved or rifled surface, ie., the raised portion between grooves. As an example, in a 50 caliber rifle, opposing land surfaces of bore 5 will be, ideally, 0.500 inches apart. The maximum diameter of the bullet 9 of the present invention will be less, ideally 0.499 inches and within a range of 0.005 inches less than the bore.

Gas check member 20 of the present invention is mounted rearwardly of the maximum diameter of the bullet, as shown in the drawings, so as to not encase or surround the bullet itself, as shown in FIG. 2. In this manner, the gas check member is not located between bullet and bore and therefore cannot interfere with the bullet's engagement with the surface of the bore during the firing procedure. The external diameter of the gas check member is constant and exceeds the diameter of the bore within a range of 0.001 to 0.012 inches, a diameter in excess of bore 5 by 0.004–0.006 inches being preferred. Ie., the diameter of the gas check member would be 0.505 inches in the present illustration. The gas check member is constructed of a suitable resilient plastic material and engages the bore surface to hold the projectile in place prior to firing and serves as a gas check member during the firing procedure to prevent escape of gases, generated during firing, around the projectile. On smooth bore firearms the gas check member, having a smooth circular outer surface 21, engages the bore surface sufficiently to prevent entry of moisture from the barrel to the powder.

For mounting the gas check member 20 to the bullet 9, two differing attachment means 30 are preferably employed. A first attachment means, shown to advantage in FIGS. 2 and 3, utilizes a pin 31, co-axial with the bullet and rearwardly extending from the bullet. The pin preferably is circular in cross-section, and has a diameter of approximately 0.187 inches and a length of 0.125 inches, exact measurements being of little importance, and is preferably integral with the bullet for manufacturing efficiency. For the first attachment means, the gas check member includes, in its base 22, a co-axial circular opening or aperture 21, having an inside diameter slightly less than that of the pin for frictionally engaging the pin. In that the gas check member is constructed of resilient material, the aperture is expanded by press fitting the gas check member on the pin by hand. The gas check member is also readily removed by hand. It is to be noted, that there is no lateral force developed between gas check member 20 and bullet 9 during the loading or firing procedure and only a minimum of lateral force applied between the gas check member and pin. Such construction allows unobstructed obturation contact between the bullet and the bore during firing, for accuracy.

A second attachment means, shown in FIGS. 4 and 5, includes a bullet 9 provided with an elongated slot 39, circular in cross section, opening at the base of the bullet, and co-axial with the bullet; and a gas check member 20 provided with a resilient pin 29 which is slightly larger in diameter than slot 39 for manual press fitting into the slot. Like the first attachment means, there is no lateral force developed between the gas check member and the bullet during the loading or firing procedure and the gas check member is readily attached, by hand, to the bullet prior to loading. Where the pin and slot or aperture are both circular in cross-section, rotational force between the pin and slot is minimized.

For use, bullet 9 is manually mounted by placing the rear surface of the bullet directly on and flush with the top surface of base 22 of gas check member 20 with either the opening 21 of the gas check member matingly engaging the pin 31 extending rearwardly of the bullet or pin 29 of the gas check member inserted into slot 39 of the bullet, as the case may be. Projectile 10 is then pushed into the muzzle and ram-rodded down until the gas check member is seated directly over the powder charge in firm contact with the surface of the bore. The projectile is thus centered in the bore, without scoring of the bullet by the rifling or deformation of the bullet by the ramming procedure. Upon firing of the firearm, the gas check member provides increased velocity to the bullet by virtually eliminating blowby. It has been found that such "undersized" bullet obturates, ie., increases in diameter to engage the rifling of the bore, where rifling is present, to impart spin to the bullet.

Such "undersized" bullet of the present invention, because of minimizing contact with the bore; because its placement within the bore is without scoring and without deformation; because its attachment to the gas check member is by friction only and therefore detachment between bullet and gas check member, upon firing of the firearm is immediate; and because of lack of interference between the bullet and bore by the gas check member; provides greater accuracy; higher bullet velocity; flatter trajectory; and greater terminal energy as the bullet meets the target.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A muzzle loading projectile for a muzzle loading firearm, said muzzle loading firearm having a barrel with a bore of a certain diameter, said muzzle loading projectile consisting of:

a one-piece bullet of obturating material and circular cross-section, said bullet having a tapered front portion, a cylindrical middle body portion, and a flat rear end, the bullet cylindrical middle body portion having a certain maximum diameter which is less than the diameter of said bore in said barrel, and said flat rear end having a flat rear surface with a rearwardly extending cylindrical pin co-axial with said bullet, said cylindrical pin having a diameter and the ratio of the diameter of the cylindrical pin to the maximum diameter of said bullet cylindrical middle body portion being about 0.375; and a one-piece gas check member of resilient plastic material and circular cross-section, said gas check member having a flat front end, a gas check cylindrical middle body portion and recessed rear end, the flat front end having a cylindrical aperture co-axial with said gas check member, said aperture having an inside dimension slightly less than the diameter of said rearwardly extending cylindrical pin of said bullet, the cylindrical pin of said bullet being frictionally engageable and disengageable within the aperture for releasably attaching said gas check member to said bullet so that the gas check member is readily detachable from said one-piece bullet upon firing of the firearm, the gas check cylindrical body portion having a certain maximum diameter which is greater than the diameter of said bore in said barrel, said gas check cylindrical body portion having a certain body portion length which is less than a length of said bullet cylindrical body portion, and the recessed rear end having a smooth side wall which decreases gradually in thickness towards the rear end of said gas check member.

2. A muzzle loading projectile for a muzzle loading firearm, said muzzle loading firearm having a barrel with a bore of a certain diameter, said muzzle loading projectile consisting of:

a one-piece bullet of obturating material and circular cross-section, said bullet having a tapered front portion, a cylindrical middle body portion, and a flat rear end, the bullet cylindrical middle body portion having a certain maximum diameter which is less than the diameter of said bore in said barrel, and said flat rear end having a flat rear surface with a forwardly extending cylindrical hole co-axial with said bullet; and a one-piece gas check member of resilient plastic material and of circular cross-section, said gas check member having a flat front end, a gas check cylindrical middle body portion and a recessed rear end, the flat front end having a forwardly extending cylindrical pin co-axial with said gas check member, said cylindrical pin having a diameter slightly greater than the inside dimension of said forwardly extending cylindrical hole of said bullet, the ratio of the diameter of the cylindrical pin to the maximum diameter of said bullet cylindrical middle body portion being about 0.375, the cylindrical pin of said gas check member being frictionally engageable and disengageable within the hole in said bullet for releasably attaching said gas check member to said bullet so that the gas check member is readily detachable from said one-piece bullet upon firing of the firearm, the gas check cylindrical body portion having a certain maximum diameter which is greater than the diameter of said bore in said barrel, said gas check cylindrical body portion having a certain body portion length which is less than a length of said bullet cylindrical body portion, and the recessed rear end having a smooth side wall which decreases gradually in thickness towards the rear end of said gas check member.

* * * * *